United States Patent [19]

Goodman et al.

[11] Patent Number: 4,912,005

[45] Date of Patent: Mar. 27, 1990

[54] TONER AND DEVELOPER COMPOSITIONS WITH CONDUCTIVE CARRIER COMPONENTS

[75] Inventors: Donald J. Goodman, Rochester; John F. Knapp, Fairport, both of N.Y.

[73] Assignee: Xerox Corporation, Stamford, Conn.

[21] Appl. No.: 301,671

[22] Filed: Jan. 26, 1989

[51] Int. Cl.[4] ..... G03G 9/10

[52] U.S. Cl. ..... 430/108; 428/405; 428/407

[58] Field of Search ..... 430/108; 428/405, 407

[56] References Cited

U.S. PATENT DOCUMENTS

| | | | |
|---|---|---|---|
| 3,838,054 | 9/1974 | Trachtenberg et al. | 430/108 X |
| 3,926,824 | 12/1975 | Lipani | 430/109 |
| 4,038,076 | 7/1977 | Lipani | 430/120 |
| 4,272,184 | 6/1981 | Rezanka | 355/15 |
| 4,298,672 | 11/1981 | Lu | 430/108 |
| 4,338,390 | 7/1982 | Lu | 430/106 |
| 4,609,603 | 9/1986 | Knapp et al. | 430/39 |

FOREIGN PATENT DOCUMENTS

| | | | |
|---|---|---|---|
| 56-126843 | 10/1981 | Japan | 430/108 |
| 2088076 | 7/1982 | United Kingdom . | |

*Primary Examiner*—Roland E. Martin
*Assistant Examiner*—Jeffrey A. Lindeman
*Attorney, Agent, or Firm*—E. O. Palazzo

[57] ABSTRACT

A carrier composition with a conductivity of from about $10^4$ to about $10^{10}$ (ohm-cm)$^{-1}$, and comprised of a mixture of a first carrier component and a second carrier component, at least one of said carrier components containing a polymeric coating thereover, and wherein at least one coating contains conductive particles.

51 Claims, No Drawings

TONER AND DEVELOPER COMPOSITIONS WITH CONDUCTIVE CARRIER COMPONENTS

BACKGROUND OF THE INVENTION

This invention is generally directed to toner and developer compositions, and more specifically the present invention is directed to conductive carrier compositions. In one embodiment of the present invention, the carrier compositions are comprised of a mixture of certain carrier cores with optional polymeric coatings thereover. Specifically, the carrier particles of the present invention in one embodiment are of a conductivity of from about $10^4$ to about $10^{10}$ (ohm-cm)$^{-1}$, in one specific embodiment of the present invention, there are provided developer compositions containing a mixture of carrier particles with coatings thereover, which coatings have dispersed therein conductive particles such as carbon black, and wherein the carrier particles are of a conductivity of from about $10^4$ to about $10^9$ (ohm-cm)$^{-1}$ as determined, for example, in a cell wherein a current of from about 1 to about 1,000 volts is utilized. Generally, the carrier particles of the present invention are comprised of a mixture of high, such as steel grit cores, and moderate, such as a nickel zinc ferrite carrier, conductivity carrier particles. Developer compositions can be formulated by mixing the aforementioned carrier particles with toner compositions comprised of resin particles, pigment particles, and optional additive particles inclusive of charge enhancing components, colloidal silieas, and metal salts of fatty acids. Some advantages associated with the carrier particles of the present invention include, for example, the modification of magnetic brush properties present in electrophotographic imaging systems including properties of stiffness, conductivity, ability to retain conductivity with varying amounts of toner, and the like. Moreover, with the conductive carrier particles of the present invention the toner triboelectric charging properties remain relatively constant for extended imaging cycles up to, for example, 100,000. The toner and developer compositions of the invention are useful in electrophotographic imaging and printing processes, including color processes. Further, with the toner and developer compositions of the present invention, there is enabled in the aforesaid processes substantial uniformity of the toner triboelectric charge for extended time periods. Moreover, the toner and developer compositions of the present invention enable photoconductive imaging members or ionographic receptors present in an imaging or printing apparatus to function without adverse effects for extended time periods, for example, exceeding 100,000 imaging or printing cycles.

Various developer compositions are known, reference for example U.S. Pat. No. 3,926,824, which discloses a developer with two toners and a single carrier; two carriers and a single toner; or a single toner and a single carrier, see the Abstract of the Disclosure, and column 2 begininng at line 52. As illustrated in column 2, beginning at around line 60, of the '824 patent, a single toner and two different carriers with at least a surface of the two carriers being formed of materials being selected with respect to their triboelectric properties so that one of the carriers is above and the other below the toner in the triboelectric series whereby one carrier imports a negative charge to the toner, and the other carrier imports a positive charge to the toner isrecited. Examples of specific carriers are illustrated, for example, in column 8 of the aforementioned patent. A similar teaching is presented in U.S. Pat. No. 4,038,076. Further, in U.S. Pat. No. 4,608,603 there is described the use of carrier particles consisting of a steel core, or a ferrite core with polymeric coatings thereover. In U.S. Pat. No. 4,272,184, there are illustrated conductive carriers with a resistivity of from about $10^7$ to about $10^{10}$ ohm-cm wherein the core may be seleted from iron, steel, ferrite, magnetite, nickel, and mixtures thereof, reference column 8, lines 42 to 55. Additionally, of background interest is U.K. Patent Publication No. 2,088,076, which discloses a developer comprised of two toners having different conductivities. Also, developer and toner compositions with certain waxes therein are known. For example, there are disclosed in U.K. Patent Publication No. 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Furthermore, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Illustrated in copending application U.S. Ser. No. 004,939/87, the disclosure of which is totally incorporated herein by reference, are toner and developer compositions with linear polymeric alcohols comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Coated and uncoated carrier particles are disclosed in the aforesaid copending application.

Furthermore, references of background interest are U.S. Pat. Nos. 3,165,420; 3,236,776; 4,145,300; 4,271,249; 4,556,624; 4,557,991 and 4,604,338.

Moreover, toner and developer compositions containing charge enhancing additives, especially additives which impart a positive charge to the toner resin, are well known. Thus, for example, there is described in U.S. Pat. No. 3,893,935 the use of certain quaternary ammonium salts as charge control agents for electrostatic toner compositions. There are also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions with charge enhancing additives, organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride. The '390 and '672 patents also disclose carrier components for developers, including coated carrier cores. Other prior art disclosing positively charged toner compositions with charge enhancing additives include U.S. Pat. Nos. 3,944,493; 4,007,293; 4,079,014 and 4,394,430.

Although the above described toner and developer compositions are useful for their intended purposes, there is a need for improved compositions. More specifically, there is a need for carrier compositions with certain conductivities. There is also a need for developer compositions comprised of the aforementioned carrier particles and toner particles. In addition, there is a need for toner and developer compositions that maintain their triboelectrical characteristics for extended time periods exceeding, for example, 150,000 developed images, and wherein the carrier particles are comprised of a mixture of core components with coatings thereover enabling the carriers to possess a conductivity of from about $10^4$ to about $10^{10}$ (ohm-cm)$^{-1}$. Furthermore, there is a need for colored developers that possess many of the aforementioned characteristics. There are also a need for carrier and developer compositions including color developer compositions wherein modification of the magnetic brush properties present in an electrophotographic imaging apparatus can be accomplished independent of the charging properties of the toner compositions including the brush properties such as stiffness, conductivity, and the ability to retain conductivity when toned. There is also a need for carriers which are coated with similar or substantially identical polymers and contain conductive particles therein, and wherein the coating weights are adjusted to enable similar charging properties with the toner composition selected especially the colored toner compositions. Moreover, there is a need for toner and developer compositions, particularly developers containing carrier blends comprised of a mixture of two different carrier cores, that is a first carrier core and a second carrier core, thereby enabling enhanced developer in, for example, electrophotographic imaging and printing apparatuses, it is believed, because of the combined characteristics of the different cores.

SUMMARY OF THE INVENTION

It is an object of the present invention to provide developer compositions which possess many of the advantages illustrated herein.

Another object of the present invention resides in the provision of developer compositions with stable triboelectrical characteristics for extended time periods.

In another object of the present invention there are provided developer compositions comprised of a mixture of certain carrier components.

Moreover, another object of the present invention relates to the provision of developer compositions comprised of a mixture of high and moderate conductivity carrier components.

Furthermore, in another object of the present invention there are provided positively or negatively charged toner and developer compositions useful for the development of images present on positively or negatively charged imaging members.

Additionally, in yet another object of the present invention there are provided toner and developer compositions with certain waxes therein or thereon, which waxes may contain thereon charge enhancing additives that enable images of excellent quality and that posses other advantages as illustrated herein.

In another object of the present invention there are provided positively charged toner compositions containing a mixture of different carrier components with a conductivity of from about $10^4$ to about $10^{10}$ (ohm-cm)$^{-1}$.

Additionally, in still another object of the present invention there are provided methods for the development of images, including colored images, in electrostatographic imaging systems.

Moreover, in another object of the present invention there are provided developer compositions containing a mixture of first and second carrier cores of different components, which carrier particles have a conductivity of from about $10^4$ to about $10^{10}$ (ohm-cm)$^{-1}$, which particles contain a polymeric, or polymeric coatings thereover, and wherein at least one of the coatings has present therein conductive components such as carbon black.

These and other objects of the present invention are accomplished by providing developer compositions, and toner compositions comprised of resin particles, pigment particles, and optional additives such as waxes, charge enhancing additives, and the like. More specifically, the present invention is directed to carrier particles with a conductivity of from about $10^4$ to about $10^{10}$ (ohm-cm)$^{-1}$ and comprised of a mixture of carrier cores. The aforementioned mixture in one embodiment is comprised of from about 25 to about 75, and preferably from about 50 to about 75 percent by weight of a first carrier component and a second carrier component, respectively. Accordingly, in one embodiment the carrier particles of the present invention are comprised of from about 25 to about 75 percent by weight of a first high conductivity carrier such as steel grit; and from about 75 to about 25 percent by weight of a second moderate conductivity carrier such as a ferrite including nickel zinc ferrites. Also, the carrier particles of the present invention can be comprised of from about 25 to about 75 percent by weight of a moderate conductivity carrier, and from about 75 to about 25 percent by weight of a high conductivity carrier. Furthermore, carrier mixtures comprising from about 1 to about 99 percent by weight of a high conductivity carrier, and from about 99 to about 1 percent by weight of a moderate conductivity carrier can be selected providing the objectives of the present invention are achieved. Similarly, there may be selected for the invention of the present application carrier components, or cores comprised of a mixture with from about 1 to 99 percent by weight of a moderate conductivity carrier, and from about 99 to about 1 percent by weight of a high conductivity carrier, and wherein at least one of the carriers contains a polymeric coating.

The aforementioned carriers preferably contain a polymeric coating thereover, and conductive particles therein such as carbon black, inclusive of Vulcan blacks, in an amount of, for example, from about 1 to about 35 weight percent, and preferably in an amount of from about 10 to about 20 weight percent of conductive particles. Usually, the carrier mixture is comprised of a first carrier core and a second different carrier core wherein the first carrier core is of moderate conductivity, such as a ferrite core, and the second carrier core is of high conductivity, such as Hoeganaes steel, or steel grit, which cores contain polymers thereover, and in a preferred embodiment, similar or substantially identical polymer coatings with typical coating weights of from about 0.2 weight percent to about 4 weight percent, and preferably from about 0.2 weight percent to about 2.0 weight percent; and wherein at least one of the polymeric coatings contains therein or has been doped with conductive particles, such as carbon black. Accordingly, in one embodiment of the present invention the high conductivity carrier core with a coating thereover can be doped with from about 0 to about 25 percent by weight of carbon black, while the moderate conductivity carrier core with a coating thereover, which carrier core is comprised of a different material than the first high conductivity carrier core, contains from about 1 to about 35 weight percent of conductive particles such as carbon black. Preferably, the carrier core mixture is comprised of a 50 to 50 ratio of first high conductivity carrier core and second moderate conductivity carrier core.

One specific embodiment of the present invention is directed to a carrier composition with a conductivity of from about $10^4$ to about $10^{10}$ (ohm-cm)$^{-1}$, and comprised of a mixture of a first carrier component and a second carrier component, said components containing polymeric coatings thereover, and wherein at least one of the coatings contains conductive particles. In another embodiment of the present invention, there is provided a carrier composition with a conductivity of from about $10^4$ to about $10^{10}$ (ohm-cm)$^{-1}$, and comprised of a mixture of a first high conductivity carrier component and a second moderate conductivity carrier component, or core, said components containing polymeric coatings thereover, and wherein at least one of the coatings contains conductive particles. Further, in acordance with the present invention only one of the carrier cores may contain a coating thereover.

As preferred carrier components for the aforementioned compositions, there are selected steel and ferrite core materials, particularly with a polymeric coating in a weight percentage of from about 0.5 to about 3, and preferably from about 0.6 to about 1.0, thereover including terpolymers of styrene, methacrylate, and a triethoxy silane, the coatings as illustrated in copending applications U.S. Ser. Nos. 751,922; 136,792 and 136,791, the disclosures of which are totally incorporated herein by reference, and the like. One particularly preferred coating illustrated in the aforementioned '922 copending application is comprised of a copolymer of vinyl chloride and trifluorochloroethylene with conductive substances dispersed in the polymeric coating inclusive of, for example, carbon black. In one embodiment, there is disclosed in the aforementioned copending application a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers. In the aforementioned '792 and '791 copending applications, there are illustrated developer compositions with carrier particles containing a first and second coating thereover, which coatings are not in close proximity in the triboelectric series.

Preferred carrier mixtures selected for the developer compositions of the present invention include a high conductivity carrier such as a Hoeganaes steel core containing a coating of a methyl terpolymer, reference U.S. Pat. Nos. 3,467,634 and 3,526,533, the disclosures of which are totally incorporated herein by reference, wherein the coating weight is from about 0.2 percent to about 2.0 weight percent, and preferably 1.2 weight percent, which coating has been doped with from about 0 to about 25 weight percent of conductive particles such as carbon black, and more preferably Vulcan carbon black; and wherein the second different carrier core is comprised of a moderate conductivity carrier such as a ferrite core with a methyl terpolymer coating in an amount of from about 0.2 to about 2.0 percent and preferably 0.60 percent, which coating contains carbon black in an amount of from about 1 to about 20 weight percent, and preferably 20 weight percent.

Another embodiment of the present invention is directed to a carrier composition with a conductivity of from about $10^4$ to about $10^{10}$ (ohm-cm)$^{-1}$, and comprised of a mixture of a first carrier component and a second carrier component, at least one of said components containing a polymeric coating thereover, and wherein the coating, or coatings contains conductive particles.

Illustrative examples of suitable toner resins selected for the toner and developer compositions of the present invention, and present in various effective amounts such as, for example, from about 65 percent by weight to about 95 percent by weight, include polyesters, polyamides, epoxy resins, polyurethanes, polyolefins, vinyl resins, and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; styrene butadiene copolymers, especially styrene butadiene copolymers prepared by a suspension polymerization process reference, U.S. Pat. No. 4,558,108, the disclosure of which is totally incorporated herein by reference; mixtures thereof; and the like.

As one preferred toner resin, there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as Pliolites® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, including those commercially available as Mapico Black, they are present in the toner composition in an amount of from about 10 percent by weight to about 75 percent by weight, and preferably in an amount of from about 10 percent by weight to about 35 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

Also encompassed within the scope of the present invention are colored toner compositions containing as pigments or colorants red, blue, brown, green, magenta, cyan, and/or yellow particles as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color index as Foron Yellow SE/GLN, CI Dispersed Yellow 33, 2,5-dimethoxy-4-sulfonanilide phenylazo-4'-chloro-2,5-dimethoxy aceto-acetanilide, Permanent Yellow FGL, red, blue, green, brown, Lithol Scarlet, and the like. These pigments are generally present in the toner composition in an amount of from about 2 weight percent to about 15 weight percent based on the weight of the toner resin particles.

Illustrative examples of optional charge enhancing additives present in various effective amounts, such as, for example, from about 0.1 to about 20 percent by weight, and preferably from about 1 to about 5 weight percent, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; TRH available from Hodogaya; potassium tetraphenyl borate; orthophenyl carboxylic acids; and other known similar charge enhancing additives providing the objectives of the present invention are accomplished; and the like. The triboelectric charge on the toner is dependent on the charge control additive selected, for example; usually a positive charge is obtained with alkyl pyridinium halides, the methyl sulfate, and the like; and a negative charge is obtained with TRH, potassium tetraphenyl borate and orthocarboxylic acids. The magnitude of the charge is dependent on the carrier coating selected and other factors, however, the triboelectric charge of the toner is usually from about 10 to about 35, and preferably from about 20 to about 40 microcoulombs per gram.

Illustrative examples of carrier particles that can be selected for mixing with the toner compositions of the present invention include those particles that are capable of triboelectrically obtaining a charge of opposite polarity to that of the toner particles and possess the other characteristics as illustrated herein. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carriers that may be selected include cores of steel, nickel, iron, ferrites, steel grit, nickel-zinc-ferrites, and the like, see U.S. Pat. Nos. 3,839,029; 3,849,182; 3,914,181; 4,042,518 and 3,929,657, the disclosures of each of these patents being totally incorporated herein by reference. Additionally, there can be selected as one of the carrier particle components nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier mixtures selected for the present invention are comprised of a magnetic, such as steel, and a ferrite core each with a polymeric coating, or coatings thereover several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers particularly useful for some embodiments of the present invention are those comprised of steel and ferrite core, in a 50/50, or 25/75 mixture, with a coating thereover for each core of a vinyl chloride/trifluorochloroethylene copolymer or a terpolymer, which coating contains therein conductive particles, such as carbon black. Other coatings for each of the cores include fluoropolymers, such as polyvinylidenefluoride resins, poly(-chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers a mixture of components comprised of a steel and ferrite core with a double polymer coating thereover, reference U.S. Ser. Nos. 136,791, and 136,792, the disclosures of which are totally incorporated herein by reference. More specifically, there is detailed in these applications a process for the preparation of carrier particles with substantially stable conductivity parameters, which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 10 microns to about 1,000 microns, and preferably from about 10 to about 500 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

Generally, the coating weight is from about 0.1 percent to about 4 percent, and preferably from about 0.2 percent to about 2.0 percent by weight, which coating preferably contains therein 20 percent by weight of conductive particles such as carbon black. More specifically, the first high conductivity particles are comprised of a steel grit core with a coating thereover of about 1 percent by weight of a terpolymer, reference U.S. Pat. Nos. 3,467,634 and 3,526,533, the disclosures of which are totally incorporated herein by reference; and the second carrier particles are comprised of a second moderate conductivity core containing about 0.6 percent of a polymeric coating, such as the aforementioned terpolymers with 20 percent by weight of conductive particles, such as carbon black, therein, which carriers are mixed together in proportions ranging preferably from about 25 to about 75 for the first carrier, and from about 75 to about 25 for the second carrier. Also, the polymer coating can be solution coated with the conductive particles such as carbon black and the final mixture of carrier particles is incorporated into a blender for thorough mixing. Moreover, in a preferred embodiment of the present invention the carrier mixture is comprised of a first high conductivity carrier core such as Hoeganaes steel with a coating thereover, which coating contains or is doped with from about 0 to about 25 weight percent of conductive particles such as carbon black, and wherein the coating weight is from about 0.2 to about 2.0 weight percent; and the moderate conductivity carrier core, such as a ferrite core, with a polymeric coating thereover in an amount of from about 0.2 to about 2.0 weight percent, and preferably 0.62 weight percent, which coating contains or is doped with carbon black in an amount of from about 1 to about 35 weight percent, and preferably 20 weight percent. In a preferred embodiment, the aforementioned carrier core mixture is comprised of a 50 to 50 ratio of high and moderate conductivity carrier cores.

The toner compositions of the present invention can be prepared by a number of known methods, including mechanical blending and melt blending the toner resin particles, pigment particles or colorants, and additives followed by mechanical attrition. Other methods include those well known in the art such as spray drying, mechanical dispersion, melt dispersion, extrusion, dispersion polymerization, and suspension polymerization. In one dispersion polymerization method, a solvent dispersion of the resin particles, the pigment particles, and additives are spray dried under controlled conditions to result in the desired product.

The toner and developer compositions of the present invention may be selected for use in developing images in electrophotographic imaging systems, containing therein, for example, conventional photoreceptors, such as selenium and selenium alloys. Examples of selenium alloys include selenium arsenic, selenium tellurium, selenium arsenic tellurium, selenium tellurium antimony, other selenium binary and tertiary alloys, doped selenium and selenium alloys wherein the dopant is a halogen, and preferably is chlorine present in an amount of about 200 to about 400 parts per million, and the like. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanies, metal free phthalocyanines, squarines, perylenes, azos, and vanadyl phthalocyanines, while examples of charge transport layers include the aryl amines as disclosed in U. S. Pat. No. 4,265,990. Moreover, there can be selected as photoconductors hydrogenated amorphous silicon; or ionographic receptors such as hydrogenated amorphous silicon carbide; and the like.

Moreover, the toner and developer compositions of the present invention are particularly useful with electrophotographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles; means for causing the flexible imaging means to move at a speed of from about 5 cm/sec to about 50 cm/sec; means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeter to about 1.5 millimeters.

One preferred developer composition of the present invention is comprised of a toner composition with styrene butadiene resin particles (91/9), about 9 weight percent of a cyan pigment, about 1.0 percent by weight of the charge enhancing additive distearyl dimethyl ammonium methyl sulfate, and a mixture of carrier particles comprised of 50 weight percent of ferrite beads coated with 0.6 weight percent of an 80/20 mixture of methyl terpolymer/carbon black and 50 weight percent of steel grit beads coated with 1.0 weight percent of 80/20 mixture of methyl terpolymer/carbon black. Other preferred toner and developer compositions are illustrated herein, including those recited in the working examples that follow.

The following examples are being submitted to further define various species of the present invention. These examples are intended to illustrate and not limit the scope of the present invention. Also, parts and percentages are by weight unless otherwise indicated.

EXAMPLE I

There was prepared by melt blending, followed by mechanical attrition, jetting, and classification, a toner composition comprised of about 92 percent by weight of a styrene n-butylmethacrylate copolymer resin (65/35) and 8 percent by weight of cyan pigment particles comprised of copper tetraphthalocyanines available as Heliogen Blue OS. Subsequently, there was prepared by blending a carrier mixture comprised of first carrier particles and second carrier particles. More specifically, there was blended 50 percent by weight of moderate conductivity carrier particles comprised of a nickel-zinc-ferrite core with a coating thereover, 0.62 percent by weight, of a terpolymer of styrene methacrylate and triethoxy silane, reference U.S. Pat. Nos. 3,467,634 and 3,526,533, the disclosures of which are totally incorporated herein by reference. Subsequently, the aforesaid coating was admixed with 20 percent by weight of Vulcan carbon black particles resulting in carbon black particles incorporated into the coating. A high conductivity carrier core comprised of Hoeganaes steel with a coating of 1.2 weight percent thereover of the aforementioned terpolymer, which polymer coating contained therein 20 percent by weight of Vulcan carbon black particles, was mixed, 50 weight percent, of the moderate conductivity carrier core in a blender. The resulting carrier mixture had a conductivity of $10^7$ $(\text{ohm-cm})^{-1}$ as determined in a cell wherein a current of 400 volts was utilized. The toner had a triboelectric charge of a positive 35 microcoulombs per gram as determined by the known Faraday Cage apparatus.

Thereafter, the above formulated developer composition was incorporated into an electrostatographic imaging device with a toner transporting means, a toner metering charging means, and a development zone as illustrated in U.S. Pat. No. 4,394,429; and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as Makrolon®, reference U.S. Pat. No. 4,265,990, the disclosure of which is totally incorporated herein by reference. There resulted images of excellent resolution with no background deposits, and moreover the carrier particles maintained their conductivity for 100,000 imaging cycles. Also, the triboelectric charge of 35 microcoulombs per gram, as determined by the known Faraday cage method, on the toner particles was maintained for 70,000 imaging cycles.

EXAMPLE II

Toner and carrier compositions were prepared by repeating the procedure of Example I with the exception that there was selected 75 percent by weight of the high conductive carrier particles and 25 percent by weight of the moderate conductive carrier particles, and substantially similar results were obtained.

Also, the magnetic permeability for the blend of carrier particles of this Example was 63, while for Example I it was 88.

EXAMPLE III

A toner composition was prepared by repeating the procedure of Example I with the exception that there was selected 46.5 weight percent of a styrene butadiene resin, 91 percent by weight of styrene and 9 percent by weight of butadiene; 46 weight percent of a styrene n-butyl methacrylate copolymer, 58 percent by weight of styrene and 42 percent by weight of n-butyl methacrylate; 7.5 weight percent of the cyan pigment Sudan Blue, and as surface additives 0.3 percent by weight of Aerosil R972 and 0.35 weight percent of zinc stearate.

The toner composition contained no charge enhancing additive in contrast to the toner of Example I. Thereafter, a developer was prepared by blending the aforementioned prepared Sudan Blue toner with the carrier mixture of Example I, and the formulated developer had substantially similar characteristics as the developer of Example I. Also, when this developer is incorporated into the electrostatographic imaging device of Example I, it is believed that substantially similar results can be obtained.

The toner compositions of the present invention can also include other additives as indicated herein, such as waxes, including alkylenes, polymeric alcohols, and the like. The alcohols assist in avoiding the accumulation of toner debris on the imaging member surface, and comatene. These additives can, for example, be present as external or internal components in an amount of from about 1 to about 20 weight percent, and preferably from about 1 to about 10 weight percent. Other additives may be selected providing the objectives of the present invention are achievable.

Other modifications of the present invention may occur to those skilled in the art subsequent to a review of the present application. The aforementioned modifications, including equivalents thereof are intended to be included within the scope of the present invention.

What is claimed is:

1. A carrier composition with a conductivity of from about $10^4$ to about $10^{10}$ (ohm-cm)$^{-1}$, and comprised of a mixture of a first carrier component and a second carrier component, at least one of said carrier components containing a polymeric coating thereover, and wherein at least one coating contains conductive particles.

2. A carrier composition with a conductivity of from about $10^4$ to about $10^{10}$ (ohm-cm)$^{-1}$, and comprised of a mixture of a first carrier component present in an amount of from about 25 to about 75 percent by weight, and a second carrier component present in an amount of from about 75 to about 25 percent by weight, said components containing a polymeric coating thereover, and wherein at least one of the coatings contains conductive particles.

3. A carrier composition in accordance with claim 2 comprised of a mixture of a first steel carrier component present in an amount of from about 25 to about 50 percent by weight, and a second ferrite carrier component present in an amount of from about 75 to about 50 percent by weight.

4. A carrier composition in accordance with claim 1 wherein the coatings contain conductive particles.

5. A carrier composition in accordance with claim 2 wherein the coatings contain conductive particles.

6. A carrier composition in accordance with claim 3 wherein the coatings contain conductive particles.

7. A carrier composition in accordance with claim 1 comprised of a mixture of a first high conductivity carrier core and a second moderate conductivity carrier core, which first and second carrier cores contain a polymeric coating, or coatings, and wherein at least one of the coatings contains conductive particles.

8. A carrier composition in accordance with claim 7 wherein the coatings contain conductive particles.

9. A carrier composition in accordance with claim 7 wherein the conductive particles are carbon black.

10. A carrier composition in accordance with claim 7 wherein the carrier coating weight is from about 0.2 to about 2.0 weight percent.

11. A carrier composition in accordance with claim 7 wherein the conductive particles are present in an amount of from about 1 to about 25 weight percent.

12. A carrier composition in accordance with claim 8 wherein the conductive particles are present in an amount of from about 1 to about 25 weight percent.

13. A carrier composition in accordance with claim 7 wherein the high conductivity carrier core is comprised of steel.

14. A carrier composition in accordance with claim 7 wherein the moderate conductivity carrier core is comprised of a ferrite.

15. A developer composition comprised of the carrier of claim 1, and toner.

16. A developer composition comprised of the carrier of claim 2, and toner.

17. A developer composition comprised of the carrier of claim 3, and toner.

18. A developer composition in accordance with claim 15 wherein the toner contains resin particles selected from the group consisting of polyesters, styrene butadienes, styrene acrylates, and styrene methacrylates.

19. A developer composition in accordance with claim 18 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

20. A developer composition in accordance with claim 18 wherein the styrene butadiene is a copolymer containing 91 percent by weight of styrene, and 9 percent by weight of butadiene.

21. A developer composition in accordance with claim 18 wherein there is selected a suspension polymerized styrene butadiene.

22. A developer composition in accordance with claim 15 wherein the toner contains pigment particles of carbon black, cyan, magenta, yellow, and mixtures thereof; or red, blue, green, or brown.

23. A developer composition in accordance with claim 15 wherein the toner contains pigment particles are comprised of magnetite.

24. A developer composition in accordance with claim 15 wherein the toner contains pigment particles comprised of a mixture of carbon black and magnetites.

25. A developer composition in accordance with claim 15 wherein the toner contains pigment particles selected from the group consisting of magenta, cyan, yellow, and mixtures thereof.

26. A developer composition in accordance with claim 15 wherein the toner contains a charge enhancing additive.

27. A developer composition in accordance with claim 26 wherein the charge enhancing additive is selected from the group consisting of distearyl dimethyl ammonium methyl sulfate, cetyl pyridinium halides, and stearyl phenethyl dimethyl ammonium tosylate.

28. A carrier composition in accordance with claim 1 wherein the coating is selected from the group consisting of a polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

29. A carrier composition in accordance with claim 1 wherein the conductivity is from about $10^5$ to about $10^{10}$ (ohm-cm)$^{-1}$.

30. A method for obtaining images which comprises generating an electrostatic latent image on a photoconductive imaging member, subsequently affecting development of this image with the developer composition of claim 15, thereafter transferring the image to a permanent substrate, and optionally permanently affixing the image thereto.

31. A method for obtaining images which comprises generating an electrostatic latent image on a photoconductive imaging member, subsequently affecting development of this image with the developer composition of claim 16, thereafter transferring the image to a permanent substrate, and optionally permanently affixing the image thereto.

32. A developer composition in accordance with claim 16 wherein the toner contains pigment particles of carbon black; cyan, magenta, yellow, and mixtures thereof; or red, blue, green, or brown.

33. A developer composition in accordance with claim 16 wherein the toner contains pigment particles comprised of magnetite.

34. A developer composition in accordance with claim 16 wherein the toner contains pigment particles comprised of a mixture of carbon black and magnetites.

35. A developer composition in accordance with claim 16 wherein the toner contains pigment particles selected from the group consisting of magenta, cyan, yellow, and mixtures thereof.

36. A developer composition in accordance with claim 16 wherein the toner contains a charge enhancing additive.

37. A developer composition in accordance with claim 36 wherein the charge enhancing additive is selected from the group consisting of distearyl dimethyl ammonium methyl sulfate, cetyl pyridinium halides, and stearyl phenethyl dimethyl ammonium tosylate.

38. A carrier composition in accordance with claim 2 wherein the carrier contains coating is selected from the group consisting of polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

39. A carrier composition in accordance with claim 3 wherein the coating is selected from the group consisting of a polychlorotrifluoroethylene-co-vinylchloride copolymer, a polyvinylidene fluoropolymer, a terpolymer of styrene, methacrylate, and an organo silane, fluorinated ethylene-propylene copolymers, and polytetrafluoroethylene.

40. A carrier composition with a conductivity of from about $10^4$ to about $10^{10}$ (ohm-cm)$^{-1}$, and comprised of a mixture of a first carrier core component and a second different carrier core component, said first and second components containing a polymeric coating thereover, and wherein the coatings have present therein conductive particles.

41. A carrier composition in accordance with claim 40 wherein the first carrier components is comprised of a high conductivity carrier core and the second carrier is comprised of a moderate conductivity carrier core.

42. A carrier composition in accordance with claim 41 wherein the high conductivity carrier core is steel and the moderate conductivity carrier is ferrite.

43. A carrier composition in accordance with claim 42 wherein the ferrite core is a copper zinc ferrite.

44. A carrier composition in accordance with claim 40 wherein the conductivity of the carrier composition is from about $10^{-5}$ to about $10^{10}$ (ohm-cm)$^{-1}$.

45. A carrier composition in accordance with claim 40 wherein the carrier coating for the first and second carrier core is comprised of a terpolymer of styrene, methacrylate, and an organosilane.

46. A carrier composition in accordance with claim 40 wherein the carrier coating weight is from about 0.2 to about 2.0 weight percent.

47. A carrier composition in accordance with claim 40 wherein the conductive particles are carbon black.

48. A carrier composition in accordance with claim 40 wherein the conductive particles are present in an amount of from about 1 to about 25 weight percent.

49. A carrier composition with a conductivity of from about $10^4$ to about $10^{10}$ (ohm-cm)$^{-1}$, and comprised of a mixture of a first carrier component present in an amount of from about 25 to about 75 percent by weight, and a second carrier component present in an amount of from about 75 to about 25 percent by weight, said components containing polymeric coatings thereover, and wherein at least one of the coatings contains conductive particles.

50. A carrier composition in accordance with claim 49 wherein the first component is comprised of steel and the component is comprised of a ferrite.

51. A carrier composition with a conductivity of from about $10^4$ to about $10^{10}$ (ohm-cm)$^{-1}$, and comprised of a mixture of a first high conductivity carrier core and a second moderate conductivity carrier core, which carrier cores contain polymeric coatings thereover, and wherein at least one of the coatings contains conductive particles.

* * * * *